US006066795A

United States Patent [19]

Hara

[11] Patent Number: 6,066,795

[45] Date of Patent: May 23, 2000

[54] TECHNIQUES OF USING COMPUTER KEYBOARD AS MUSICAL INSTRUMENT KEYBOARD

[75] Inventor: Masaki Hara, Meguro-ku, Japan

[73] Assignee: Yamaha Corporation, Hamamatsu, Japan

[21] Appl. No.: 09/251,064

[22] Filed: Feb. 18, 1999

[30] Foreign Application Priority Data

Feb. 27, 1998 [JP] Japan ..... 10-048258

[51] Int. Cl.[7] ..... G10H 7/00

[52] U.S. Cl. ..... 84/645

[58] Field of Search ..... 84/645

[56] References Cited

U.S. PATENT DOCUMENTS

| | | | |
|---|---|---|---|
| 4,662,261 | 5/1987 | Akutsu | 84/645 X |
| 4,700,604 | 10/1987 | Morikawa et al. | 84/645 X |
| 5,208,421 | 5/1993 | Lisle et al. | 84/645 |
| 5,262,580 | 11/1993 | Tanaka et al. | 84/645 X |
| 5,394,784 | 3/1995 | Pierce et al. | 84/645 X |
| 5,565,641 | 10/1996 | Gruenbaum | 84/645 X |
| 5,728,962 | 3/1998 | Goede | 84/645 X |

FOREIGN PATENT DOCUMENTS 8-305351 11/1996 Japan .

*Primary Examiner*—Stanley J. Witkowski
*Attorney, Agent, or Firm*—Graham & James LLP

[57] ABSTRACT

An apparatus for using a computer keyboard as a musical instrument keyboard, the apparatus having: a computer keyboard having a plurality of keys for generating key information upon operation of each key; a unit for switching between an enable state and a disabled state of a musical instrument keyboard function; and a MIDI data generating unit for generating MIDI data corresponding to the key information upon operation of each key of the computer keyboard if the musical instrument keyboard function is in the enabled state.

42 Claims, 12 Drawing Sheets

TECHNIQUES OF USING COMPUTER KEYBOARD AS MUSICAL INSTRUMENT KEYBOARD

This application is based on Japanese patent application No. 10-48258 filed on Feb. 27, 1998, the whole contents of which are incorporated herein by reference.

BACKGROUND OF THE INVENTION a) Field of the Invention

The present invention relates to a keyboard of a computer input device, and more particularly to techniques of using a computer keyboard as a musical instrument keyboard.

b) Description of the Related Art

Personal computers are prevailing in various fields. A personal computer is usually equipped with a keyboard and a mouse as its input device and a display as its output device. The keyboard is used for entering characters, symbols and the like.

Personal computers are also used in the field of music. If sequencer software is installed in a personal computer, the computer can be used as a music sequencer which inputs and edits musical information. A user can enter musical performance information such as notes with a keyboard or mouse and can store it in a storage device such as a hard disk. More specifically, a user enters a pitch and length of each note. This keyboard is not used, however, as a musical instrument keyboard, but it is used as a computer keyboard from which symbols and numerical numbers are entered. A musical instrument keyboard has, for example, 64 keys. When a key is depressed, sound having a pitch corresponding to the key is produced.

If a personal computer is used as a music sequencer, a user can enter musical performance information and store it in a hard disk of the personal computer. If a sound board is added to a personal computer, the musical performance information can be produced as sounds. Namely, if a personal computer music sequencer is instructed to reproduce sounds of performance information, the performance information stored in a storage medium such as a hard disk is supplied to the sound board which then produces sounds corresponding to the musical performance information.

A computer keyboard is used as a device for entering symbols, numerical numbers and the like. Even if a user can make a musical performance in real time with a musical instrument keyboard, it is very difficult for such a user to make a musical performance in real time with a computer keyboard. Operations of inputting musical performance information with a computer keyboard are much complicated and take a lot of time. It is difficult for a user to make a musical performance with a computer keyboard as easily as with a musical instrument keyboard.

A personal computer can be used when a user composes a piece of music. However, a user cannot demonstrate a full capacity of composition ability by using a personal computer keyboard more than by using a musical instrument keyboard, because complicated operations of a computer keyboard or mouse are required when musical performance information is entered, and because the operations take a lot of time. Therefore, a user cannot enter the musical performance information immediately when the user has a sudden idea of composition, hindering the creative activity of composition.

An electronic musical instrument with a keyboard compatible to musical instrument digital interface (hereinafter called a MIDI instrument) can be connected to a personal computer. MIDI is a common interface specification used for interconnection of electronic musical instruments. If a personal computer is used as a music sequencer, the personal computer can receive performance information (MIDI data) from a MIDI instrument and can store it in a storage medium such as a hard disk. It is not so easy for a novice to connect a MIDI instrument to a personal computer. The present inventor proposes to use a computer keyboard as an electronic musical instrument keyboard.

SUMMARY OF THE INVENTION

It is an object of the present invention to provide techniques of using a computer keyboard as a musical instrument keyboard.

According to one aspect of the present invention, there is provided an apparatus capable of using a computer keyboard as a musical instrument keyboard, the apparatus comprising: a computer keyboard having a plurality of keys for generating key information upon operation of each key; means for switching between an enable state and a disabled state of a musical instrument keyboard function; and MIDI data generating means for generating MIDI data corresponding to the key information upon operation of each key of the computer keyboard if the musical instrument keyboard function is in an enabled state.

By enabling the musical instrument keyboard function, the computer keyboard can be used as a musical instrument keyboard. Namely, if the musical instrument keyboard function is in an enabled state and a key of the computer keyboard is operated upon, MIDI data corresponding to the operated key is generated.

It is possible to enable the musical instrument keyboard function with a simple operation and use the computer keyboard as a musical instrument keyboard. If the musical instrument keyboard function is disabled, the computer keyboard can be used as an ordinary computer keyboard.

Even if an electronic musical instrument keyboard is not prepared, a musical performance similar to an electronic musical instrument can be made by using a computer keyboard.

DETAILED DESCRIPTION OF THE PREFERRED EMBODIMENTS

Figure 1A:
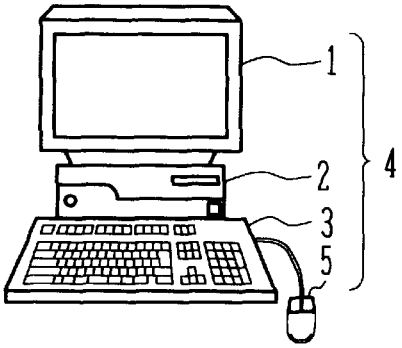
FIG. 1A is a perspective view of a personal computer.

FIG. 1A is a perspective view of a personal computer. The personal computer 4 has a main frame 2, a keyboard 3, a mouse 5, and a display unit 1. The keyboard 3 functions not only as a computer keyboard but also as a musical instrument keyboard. A user can use it as a computer keyboard such as shown in FIG. 1B when the MIDI keyboard function is disabled, or can use it as a musical instrument keyboard such as shown in FIG. 1C when the MIDI keyboard function is enabled.

Figure 1B:
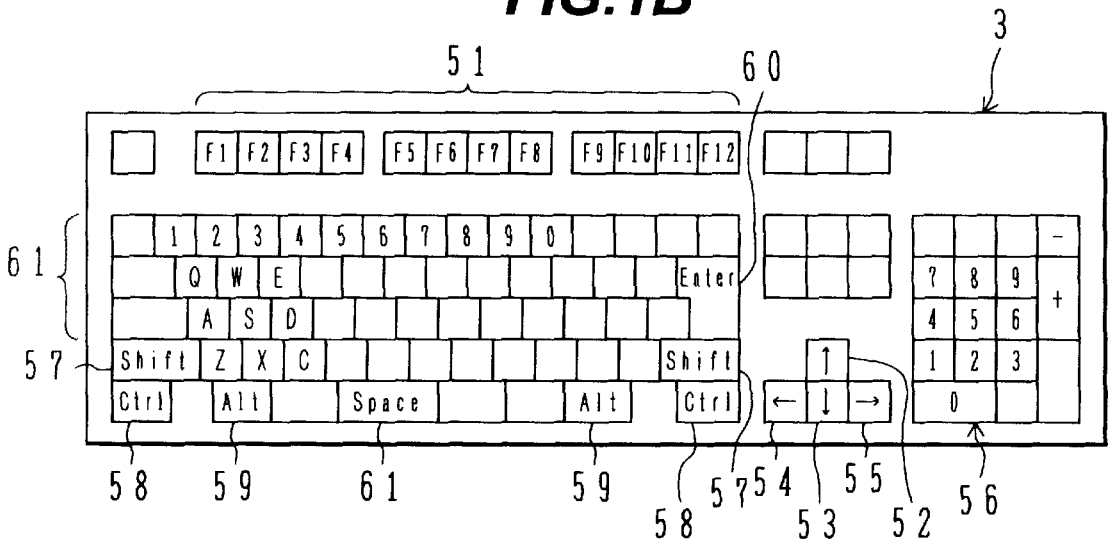
FIG. 1B shows a layout of keys when a MIDI keyboard function is disabled.
Figure 1C:
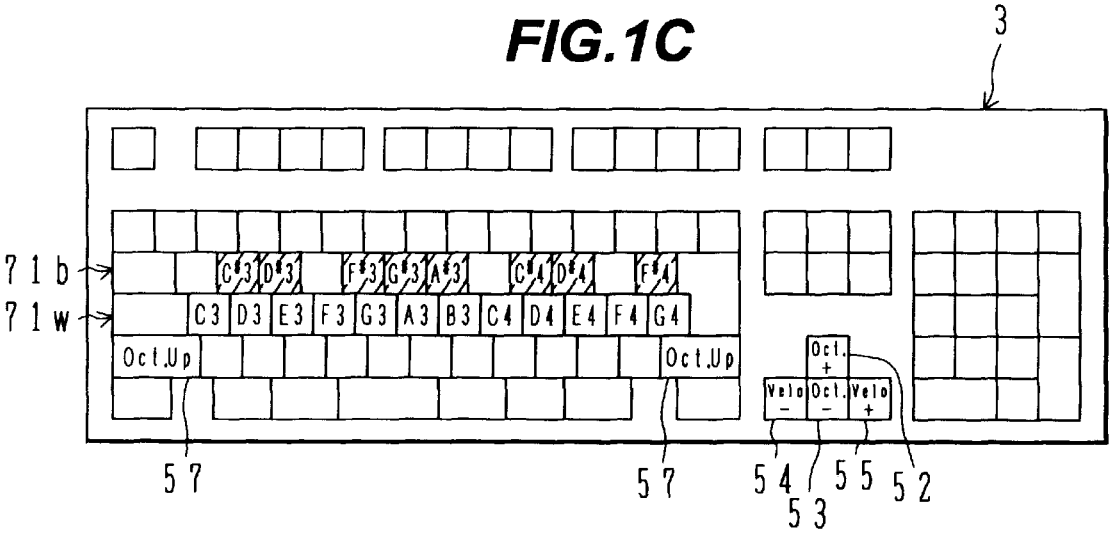
FIG. 1C shows a layout of keys when a MIDI keyboard function is enabled .

FIG. 1B shows a layout of keys of the keyboard 3 when it is used as the computer keyboard by disabling the MIDI keyboard function.

The keyboard 3 includes alphanumeric keys (alphabet keys and numerical number keys) 61, function keys 51, cursor motion keys 52 to 55, ten-keys 56, shift (Shift) keys 57, control (Ctrl) keys 58, alternate (Alt) keys 59, an enter (Enter) key 60, and a space (Space) bar 61. The ten-keys 56 include ten numerical number keys 0 to 9 and [+] and [−] keys.

The computer keyboard 3 may be a keyboard having a layout of keys according to a (national) standards institute, for example, Japanese Industrial Standards (JIS) or American National Standards Institute (ANSI), and is used as a well-known personal computer keyboard. For example, if a personal computer is used as a word processor, characters, symbols, numerical numbers and the like can be entered from the keyboard.

FIG. 1C shows a layout of keys of the keyboard 3 when it is used as the musical instrument keyboard by enabling the MIDI keyboard function.

The keyboard 3 includes white keys 71*w*, black keys 71*b* (in FIG. 1C they are hatched), and other keys 52 to 55 and 57 used as performance operators. The keys 52 to 55 correspond to the cursor motion keys shown in FIG. 1B, and the key 57 corresponds to the shift keys shown in FIG. 1B. The key 57 is used for raising an arbitrary pitch by one octave. For example, if the key 71*w* of a pitch C4 is depressed while the key 57 is depressed, sound having a pitch C5 is produced.

The key 52 is used for raising a compass by one octave. The key 53 is used for lowering a compass by one octave. The key 55 is used for increasing a velocity (sound volume). The key 54 is used for reducing a velocity.

Figure 2A:
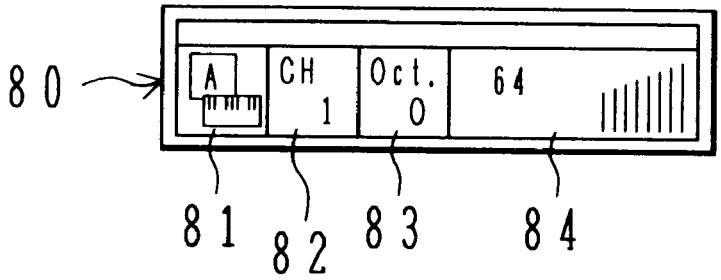
FIG. 2A shows a pallet displayed on a display device when the MIDI keyboard function is enabled.

The MIDI keyboard function can be switched between an enabled state and a disabled state by pressing the [Ctrl] key 58, [Alt] key 59, and [↑] key 52 at the same time. Since the function is switched by depressing two or more keys (e.g., three keys) at the same time, it is possible to prevent the function from being switched easily by erroneous operations. A pallet 80 shown in FIG. 2A can be displayed on the display device.

The pallet 80 has a mode display area 81, a channel display area 82, an octave display area 83, and a velocity display area 84.

Figure 3:
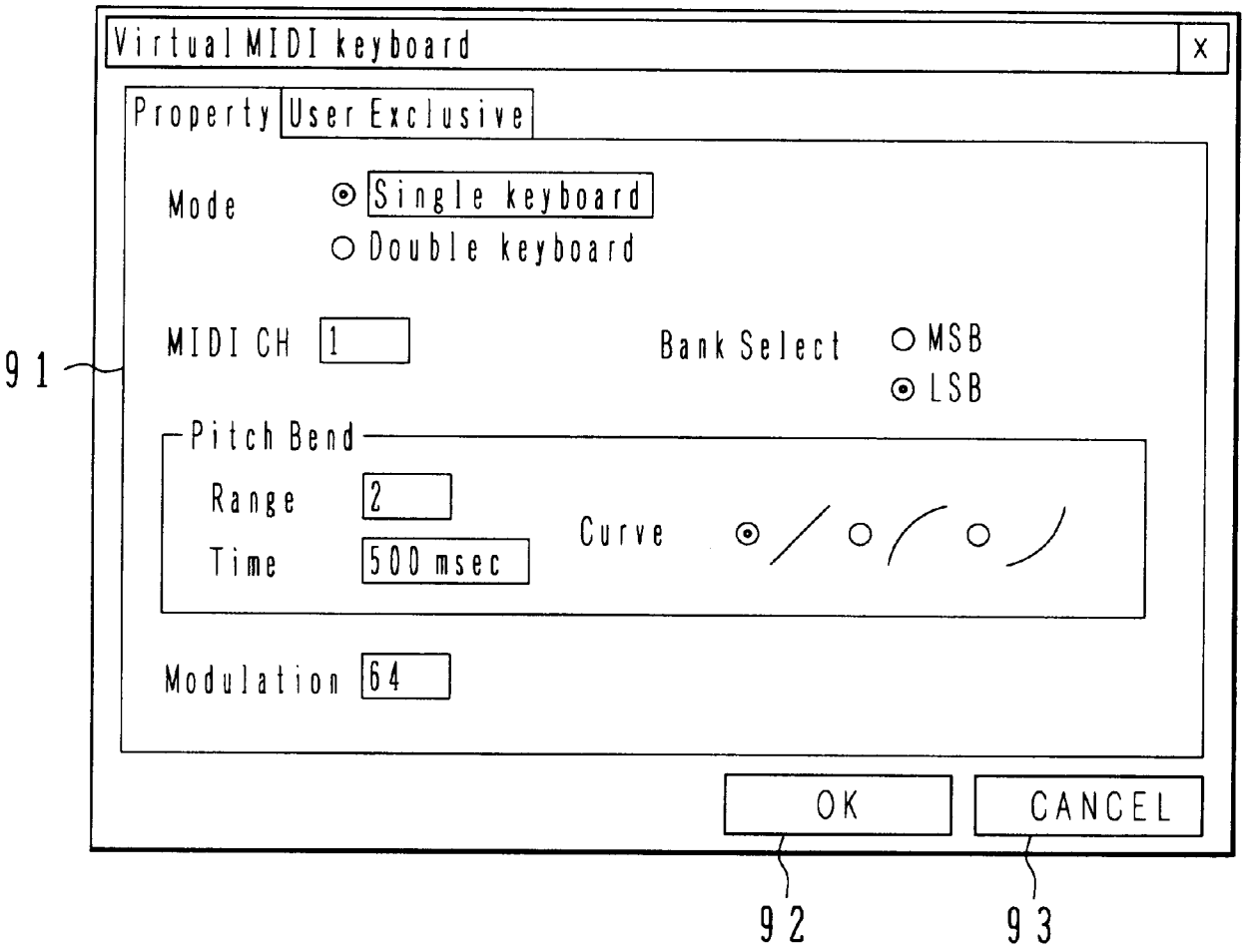
FIG. 3 shows a general setting dialog.

The mode display area 81 shows the type of a keyboard, for example, discriminates between a one-stage keyboard aabeled as Single keyboard in the general setting dialog in FIG. 3) and a two-stage keyboard (labeled as Double keyboard in the general setting dialog in FIG. 3).

The channel display area 82 shows a transmission (output) MIDI channel number. For example, the transmission MIDI channel is the first channel. When a user depresses the white key 71*w* (FIG. 1C), a note-on event corresponding to this key is output via this MIDI channel.

The octave display area 83 shows a shift amount of a compass in the unit of octave. For example, if the octave is 0, the white keys 71*w* and black keys 71*b* shown in FIG. 1C are set to a compass from a pitch C3 to a pitch G4. If the octave is 1, the keys 71*w* and 71*b* are set to a one-octave higher compass from a pitch C4 to a pitch G5.

The velocity display area 84 shows a velocity value in a note-on event. When a user depresses any one of the keys 71*w* and 71*b*, a note-on event is generated and the velocity value in the note-on event is set to the velocity value display area 84. For example, the velocity is 64 and is normally used as sound volume information.

Figure 2B:
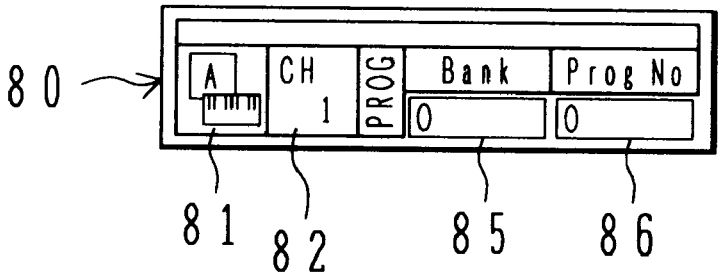
FIG. 2B shows a pallet used when a program change and a bank select is transmitted.

FIG. 2B shows the pallet 80 which displays the setting contents of a program change (MIDI data) and a bank select (MIDI data).

When a user depresses the [Shift] key 57 and [→] key 55 (refer to FIG. 1B) at the same time, the pallet 80 for the program change and bank select is displayed on the display device 1 (FIG. 1A). The pallet 80 has a mode display area 81, a channel display area 82, a bank number setting area 85, and a program number setting area 86. The bank number and program number are used for determining a tone color.

A user can set a bank number (e.g., 0) in the bank number setting area 85, and a program number (e.g., 0) in the program number setting area 86, by using numerical number keys of the ten-keys 56 (FIG. 1B). The bank number and/or program number can be increased or decreased by using the [+] or [−] key in the ten-keys 56.

If the [Enter] key 60 (FIG. 1B) is depressed after the bank and program numbers are set, a program change message (MIDI data) and bank select message (MIDI data) are generated and transmitted. These messages are transmitted via the MIDI channel displayed in the channel display area 82 (FIG. 2B).

The program change message includes a program number and is used for setting the program number. The bank select message includes a bank number and is used for setting the bank number.

A tone color is generally determined by a combination of the program number and bank number. There are program numbers 0 to 127 corresponding to 128 tone colors. There are different 128 tone colors per each bank number. Namely, the total number of tone colors is the number of banks multiplied by 128 tone colors.

The bank number is designated by two bytes, a most significant byte MSB) and a least significant byte (LSB). In performing a bank select, a user can designate which one of the MSB and LSB bank numbers is to be set. This setting is performed by using a general setting dialog (FIG. 3) to be later described.

Figure 2C:
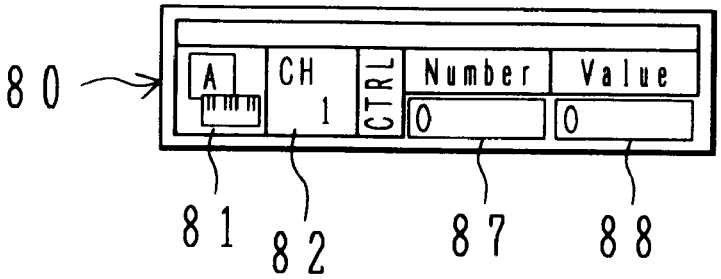
FIG. 2C shows a pallet when a control change is transmitted.

FIG. 2C shows the pallet 80 which displays a control change (MIDI data).

When a user depresses the [Shift] key 57 and [←] key (refer to FIG. 1B) at the same time, the control change pallet 80 is displayed. The pallet 80 has a mode display area 81, a channel display area 82, a control number setting area 87, and a control data setting area 88.

The user can set a control number (e.g., 0) in the control number setting area 87, and control data (e.g., 0) in the control data setting area 88, by using numerical number keys of the ten-keys 56 (FIG. 1B). The control number and/or control data can be increased or decreased by using the [+] or [−] key in the ten-keys 56.

If the [Enter] key 60 (FIG. 1B) is depressed after the control number and control data are set, a control change message (MIDI data) is generated and transmitted.

The control change message contains the control number and control data. For example, the control number "1" corresponds to a modulation wheel, the control number "2" corresponds to a breath controller, the control number "3" corresponds to an after-touch, and the control number "4" corresponds to a foot controller. The control data takes a value from 0 to 127. The control change message can transmit operation information of various performance operators (controllers). Musical tone parameters (e.g., sound volume and sound pitch) change with the control change message.

Next, the function of the keyboard when the MIDI keyboard function is enabled will be described with reference to FIGS. 1B and 1C. In the following, an expression such as [key 1 +key 2] means that the keys 1 and 2 are depressed at the same time.

(1) [Note Key]

Note keys are the while and black keys 71*w* and 71*b* of the musical instrument keyboard shown in FIG. 1C. When any one of the note keys 71*w* and 71*b* is depressed, MIDI data (note-on event) is generated which is used for producing sound having a pitch corresponding to the depressed key.

(2) [Shift +Note Key]

When the [Shift] key 57 and a note key 71*w* or 71*b* are depressed at the same time, sound having a pitch corresponding to the depressed key can be produced at a one-octave higher pitch. If the [Shift] key 57 is released thereafter and only the note key 71*e* or 71*b* is depressed, sound having the original pitch is produced.

(3) [↑]

When thee [↑] key 52 is depressed, the compass can be raised by one octave. For example, although the compass is from a pitch C3 to a pitch G4 as shown in FIG. 1C, this compass can be changed to a compass from a pitch C4 to a pitch G5. If the [↑] key 52 is again depressed, the compass can be raised further by one octave.

(4) [↓]

Contrary to the [↑] key 52, when the [↓] key is depressed, the compass can be lowered by one octave.

(5) [↑+↓]

When the [↑] key 52 and [↓] key are depressed at the same time, the compass can be reset to a default octave value (e.g., 0). The default compass is, for example, from a pitch C3 to a pitch G4.

(6) [→]

When the [→] key 55 is depressed, the velocity value can be increased. According to the MIDI specification, a note-on event has a velocity value as its parameter. The velocity value generally means a sound volume.

(7) [←]

Contrary to the [→] key, when the [κ] key 54 is depressed, the velocity value can be reduced.

(8) [←+→]

When the [←] key 54 and [→] key 55 are depressed at the same time, the velocity value can be reset to a default value. The default value is, for example, 64.

(9) [Ctrl]

The [Ctrl] key 58 corresponds to a pitch bend wheel. When the [Ctrl] key 58 is depressed, the pitch of sound under reproduction can be changed with time. The range, time, and change curve of a pitch bend can be set by using the general setting dialog (FIG. 3). It may be set that when the [Ctrl] key 58 is depressed, the pitch is raised, whereas when the [Shift] key 52 and [Ctrl] key 58 are depressed at the same time, the pitch is lowered.

(10) [Alt]

The [Alt] key 59 corresponds to a modulation wheel. When the [Alt] key 59 is depressed, the sound pitch or sound volume can be changed at a predetermined period. A depth of modulation can be set by using the general setting dialog (FIG. 3) to be described later.

(11) [Space]

The [Space] bar 61 corresponds to a damper pedal of a piano. When the [Space] bar 61 is depressed, sound can be produced which is, for example, string vibrations continuing after the damper is detached from the string.

(12) [F1]

When the [F1] key of the function keys 52 is depressed, automatic performance starts. In this case, a user can play a melody part by operating the note keys 71*w* and 71*b* while accompaniment sounds are automatically reproduced.

(13) [F2]

When the [F2] key of the function keys 51 is depressed, automatic performance stops.

(14) [F3]

When the [F3] key of the function keys 51 is depressed, the automatic performance once stopped resumes. Namely, the automatic performance starts again from the place when it was stopped by the [F2] key.

(15) [F4]

When the [F4] key of the function keys 51 is depressed, all sounds under reproduction can be extinguished (note-off).

(16) [F5]

When the [F5] key of the function keys 51 is depressed, a message of an XG system-on (XGon) can be transmitted. When the message of the XG system-on is transmitted, a tone generator is reset to predetermined standard setting values. The XG system-on is one of MIDI data stipulated by the XG specification which is a low-level specification of the MIDI specification.

(17) [F6]

When the [F6] key of the function keys 51 is depressed, a message of a general MIDI system-on (GMon) can be transmitted. When the message of the general MIDI system-on is transmitted, the tone generator is reset to predetermined standard setting values different from those reset for the XG system-on. The general MIDI system-on is one of MIDI data stipulated by the XG specification which is a low-level specification of the MIDI specification.

(18) [F7] to [F12]

The [F7] to [F12] keys of the function keys 51 can be set freely by a user by using a function key setting dialog (FIG. 6) to be described later. For example, the contents of an exclusive message can be freely set and transmitted. The exclusive message is one of MIDI data.

FIG. 3 shows th e general setting dialog. This general setting dialog can be displayed on the display device 1 if a user clicks the mode display area 81 in the pallet 80 shown in FIG. 2A with the mouse 5 (FIG. 1A). The user can interactively set the following items while this displayed dialog is looked at.

The general setting dialog has a setting area 91, an OK key 92, and a cancel key 93. The setting area 91 shows the setting contents in accordance with which the following items (1) to (9) can be set with the keyboard 3 or mouse 5.

(1) Mode

A user can select one of the two keyboard types (one-stage keyboard and two-stage keyboard). FIG. 3 shows the case where the one-stage keyboard is selected.

(1-1) One-stage Keyboard (labeled as Single keyboard in FIG. 3)

Figure 4A:
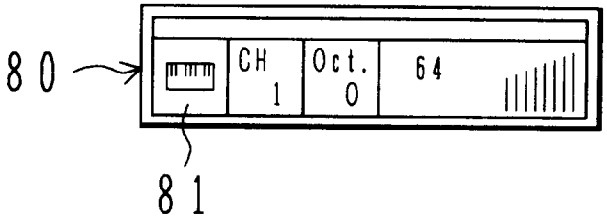
FIG. 4A shows a pallet when a one-stage keyboard is set.
Figure 4B:
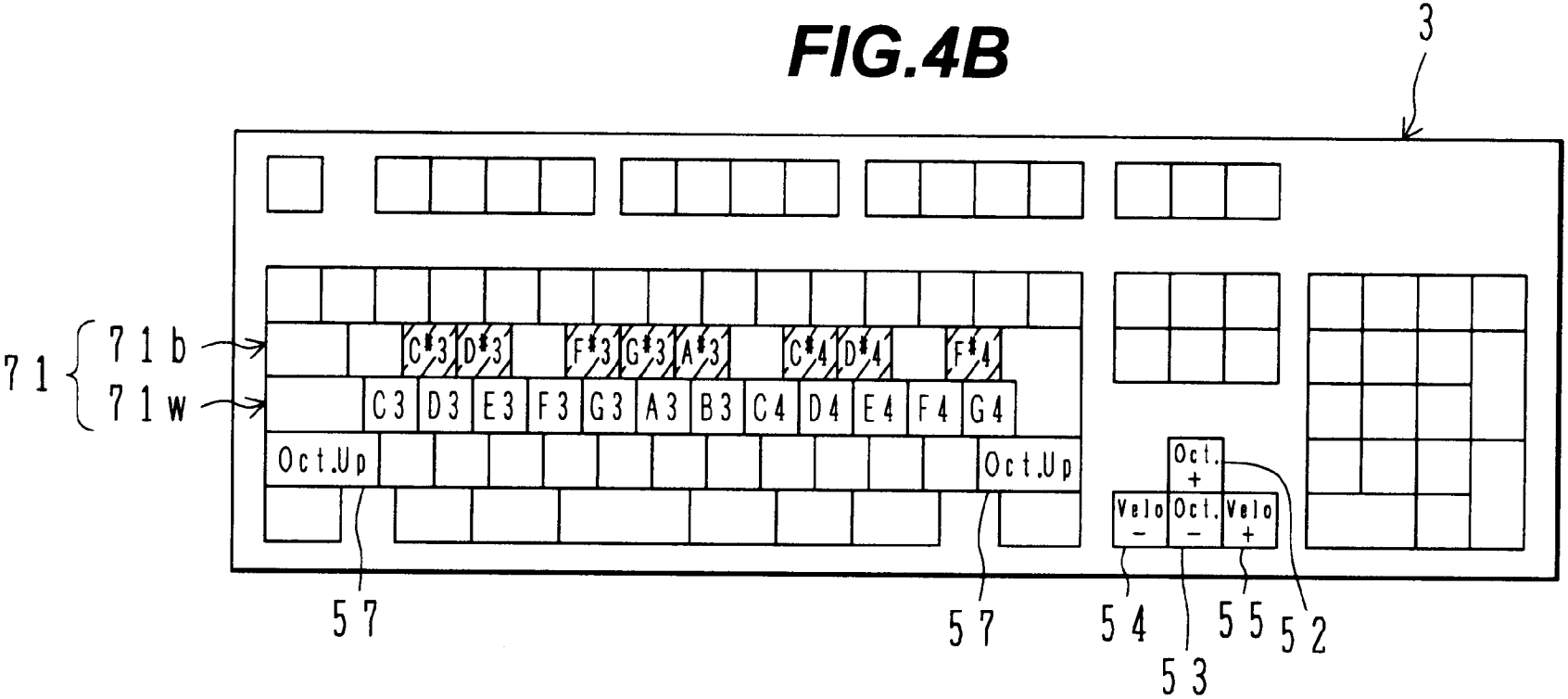
FIG. 4B shows a layout of keys when a one-stage keyboard is set.

When the one-stage keyboard is selected, a pallet 80 shown in FIG. 4A is displayed on the display unit 1 and the layout of keys of the keyboard 3 shown in FIG. 4B is set. The mode display area 81 in the pallet 80 indicates that the one-stage keyboard is b eing selected.

Similar to the keyboard shown in FIG. 1C, the keyboard 3 has one-stage keyboard keys (note keys) 71. The note keys 71 include white and black keys 71*w* andc 71*b*. The white keys 71*w* correspond to those in then compass from a pitch C3 to a pitch G4. The black keys 71*b* correspond to those in the compass from a pitch C#3 to a pitch F#4. The keys 52, 53, 54, 55, and 57 are the same as those described earlier.

(1-2) Two-stage Keyboard (labeled as Double keyboard in FIG. 3)

Figure 5A:
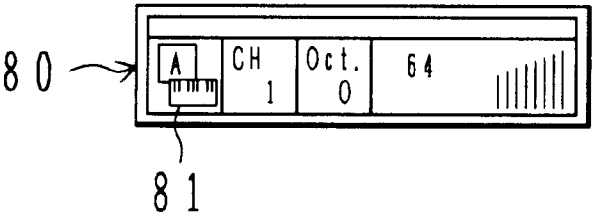
FIG. 5A shows a pallet when a two-stage keyboard is set.
Figure 5B:
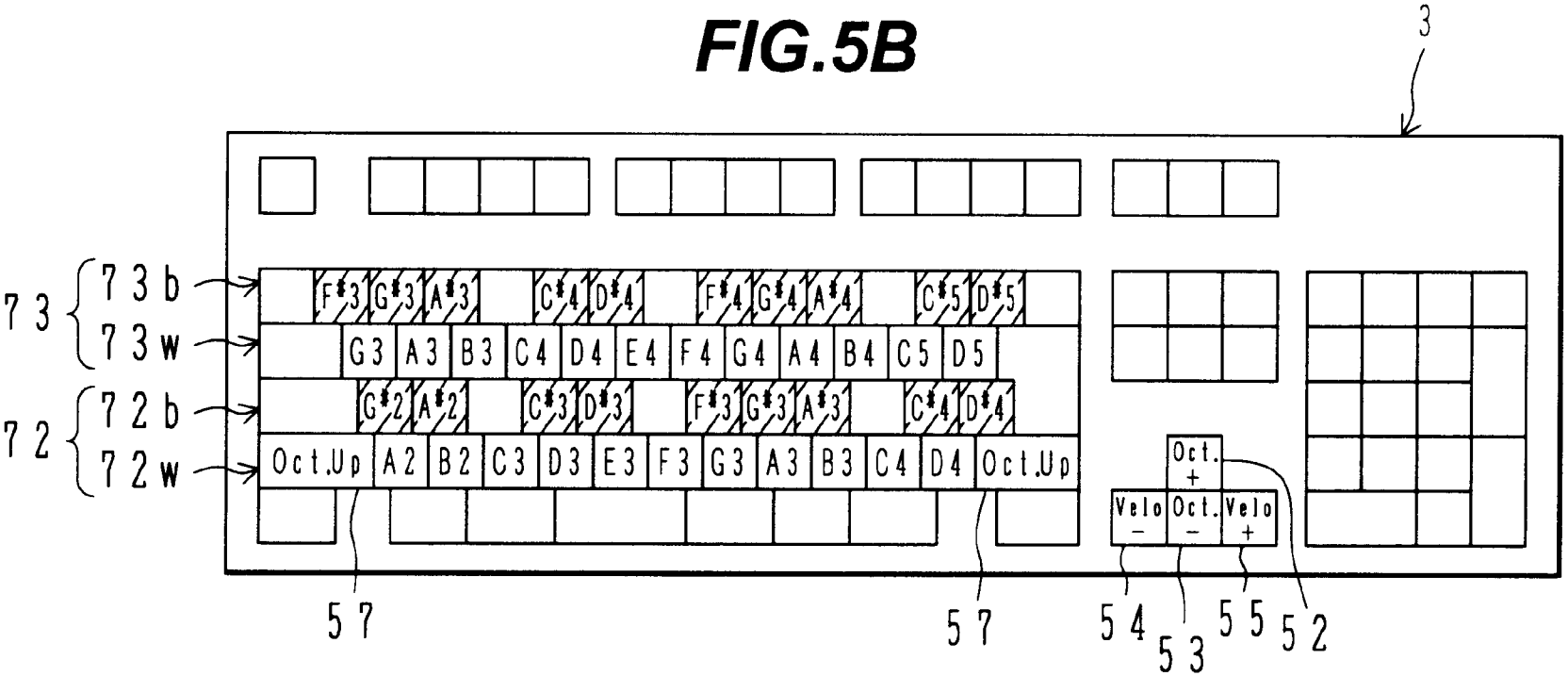
FIG. 5B shows a layout of keys when a two-stage keyboard is set.

When the two-stage keyboard is selected, a pallet 80 shown in FIG. 5A is displayed on the display unit 1 and the layout of keys of the keyboard 3 shown in FIG. 5B is set. The mode display area 81 in the pallet 80 indicates that the two-stage keyboard is being selected.

The keyboard 3 has upper-stage (left hand) keyb oard keys 72 and upper-stage (right hand) keyboard keys 73 like an Electone (electric organ). The keys 52, 53, 54, 55, and 57 are the same as those described earlier.

The lower-stage keyboard keys 72 include white and black keys 72*w* and 72*b*. The white keys 72*w* correspond to those in the compass from a pitch ge to a pitch D4. The black keys 72*b* correspond to those in the compass from a pitch G#2 to a pitch D#4.

The upper-stage keyboard keys 73 include white and black keys 73*w* and 73*b*. The white keys 73*w* correspond to those in the compass from a pitch G3 to a pitch D5. The black keys 73*b* correspond to those in the compass from a pitch F#3 to a pitch D#5.

(2) MIDI Channel (MIDI CH)

As shown in FIG. 3, a user can set a transmission MIDI channel. As the user plays a performance with the keyboard 3, MIDI data (e.g., note-on event) generated in accordance with the user performance is assigned to this transmission MIDI channel.

(3) Bank Select

A tone color number is usually determined by a combination of a program number and a bank number. The bank number is designated by two bytes, a most significant byte (MSB) and a least significant byte (LSB). In performing a bank select, a user can designate which one of the MSB and LSB bank numbers is to be set. The MSB bank number is used for selecting, for example, a melody bank or a drum bank. The LSB bank number is used for selecting, for example, a bright tone color or a dark tone color.

In performing a bank select, a user can designate which one of the MSB and LSB bank numbers is to be selected. For example, if LSB is selected, the LSB bank number can be selected by the bank select. A bank select message can be set and transmitted by the method described with FIG. 2B.

(4) Pitch Bend

As a user depresses the [Ctrl] key 58 (FIG. 1B), a pitch bend can be performed like an electronic musical instrument with a keyboard. The pitch bend changes a pitch of sound under reproduction. A user can set the following three condition parameters.

(4-1) Pitch Bend Range

A user can set a range of the pitch bend in the unit of semitone (100 cents). For example, if a range is set to "2", the pitch bend range is 200 cents. The pitch bend range can be set in a range from +12 (one octave high) to −12 (one octave low).

(4-2) Pitch Bend Time

A user can set a pitch bend time taken to reach a final target pitch of the pitch bend. This time is, for example, 500 msec and can be set in a range from 1 msec to 1 sec. When a user depresses the [Ctrl] key 58, a pitch bend event (control change message) is generated whose generation interval is determined by the pitch bend time.

(4-3) Pitch Bend Curve

A user can set a pitch bend curve, i.e., a change curve of a pitch with time (tone characteristic curve). For example, a pitch may be changed linearly upward or downward, a pitch may be changed greatly during an initial period and thereafter it is changed gradually, a pitch may be changed little during an initial period and thereafter it is changed greatly. A user can select one of these three pitch bend curves. Other bend curves may also be used.

These bend curves each have a table. The pitch bend wheel is ordinarily held at a center position by elasticity. The table stores difference data from the center value of a pitch bend operator, in correspondence with a time change. By referring to this table, the pitch bend can be realized. The details thereof will be described with reference to the flow charts shown in FIGS. 11 and 12. Instead of changing a pitch, other tone (sound) parameters such as a sound volume may be used.

(5) Modulation

A user can set a depth of modulation. The [Alt] key 59 corresponds to a modulation operator. The modulation takes a value of, for example, 64, and periodically changes a pitch or sound volume.

When a user clicks the OK key 92 with the mouse 5 after the items (1) to (5) are selected, the contents displayed in the setting area 91 are set. When the user clicks the cancel key 93 with the mouse 5, the contents set at a previous time are maintained.

Figure 6:
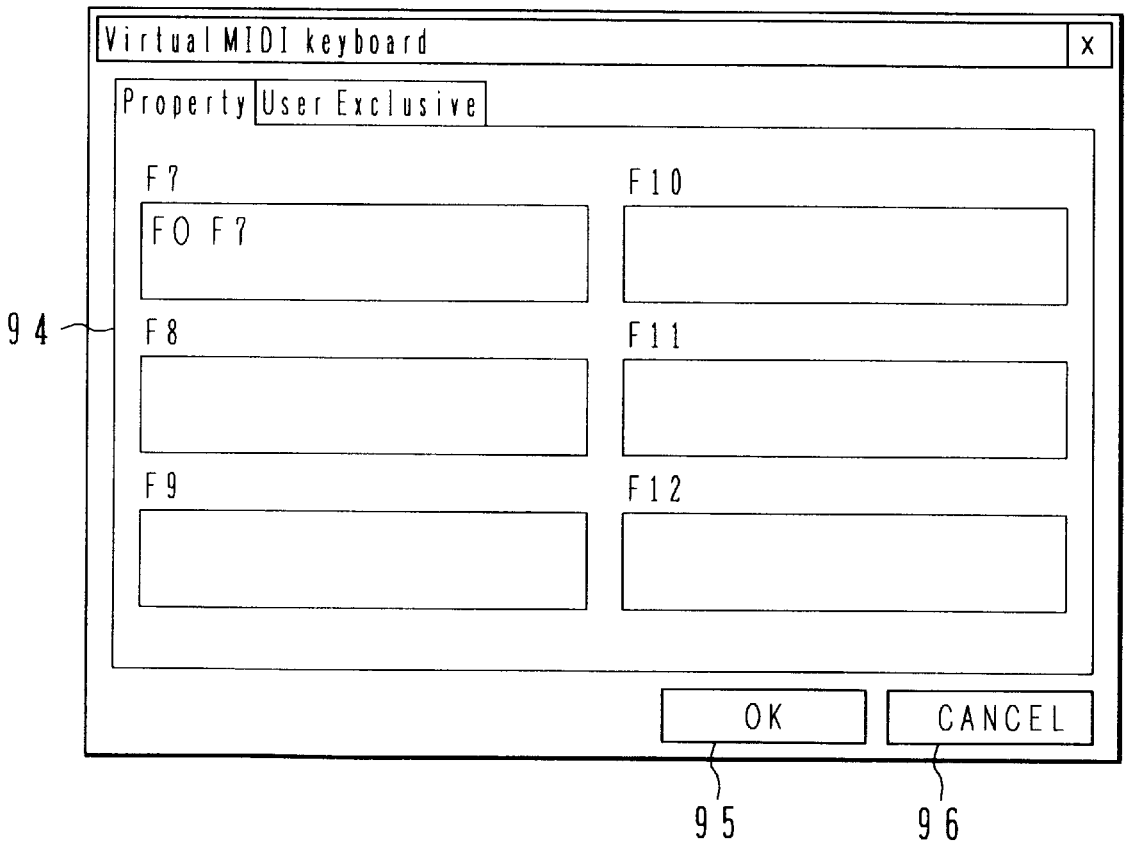
FIG. 6 shows a function key setting dialog.

FIG. 6 shows a function key setting dialog.

A user can set a specific command to each of the [F7] to [F 12] keys of the function keys 51. When the function key setting is designated, the function key setting dialog is displayed on the display device 1. The user can interactively set the following contents while the displayed dialog is looked at.

The function key setting dialog has a setting area 94, an OK key 95, and a cancel key 96. The setting area 94 is used for setting the [F7] to [F12] keys and displays the setting contents. A user can set the contents of the keys with the keyboard 3 or mouse 5. For example, a user can set the contents of an exclusive message.

For example, a user can define the [F7] key as an exclusive message of the MIDI specification. According to the MIDI specification, the start data of the exclusive message is F0 and the end data thereof is F7. Such fixed data is displayed in advance in an area assigned to the [F7] key. A user writes only the data to be defined, between F0 and F7. It is therefore possible to simplify the setting work.

When a user clicks the OK key 95 with the mouse 5 after one or more of the [F7] to [F12] keys are defined, the contents displayed in the setting area 94 a reset. When the user clicks the cancel ket 96 with the mouses 5, the contents set at a previous time are maintained.

Figure 7:
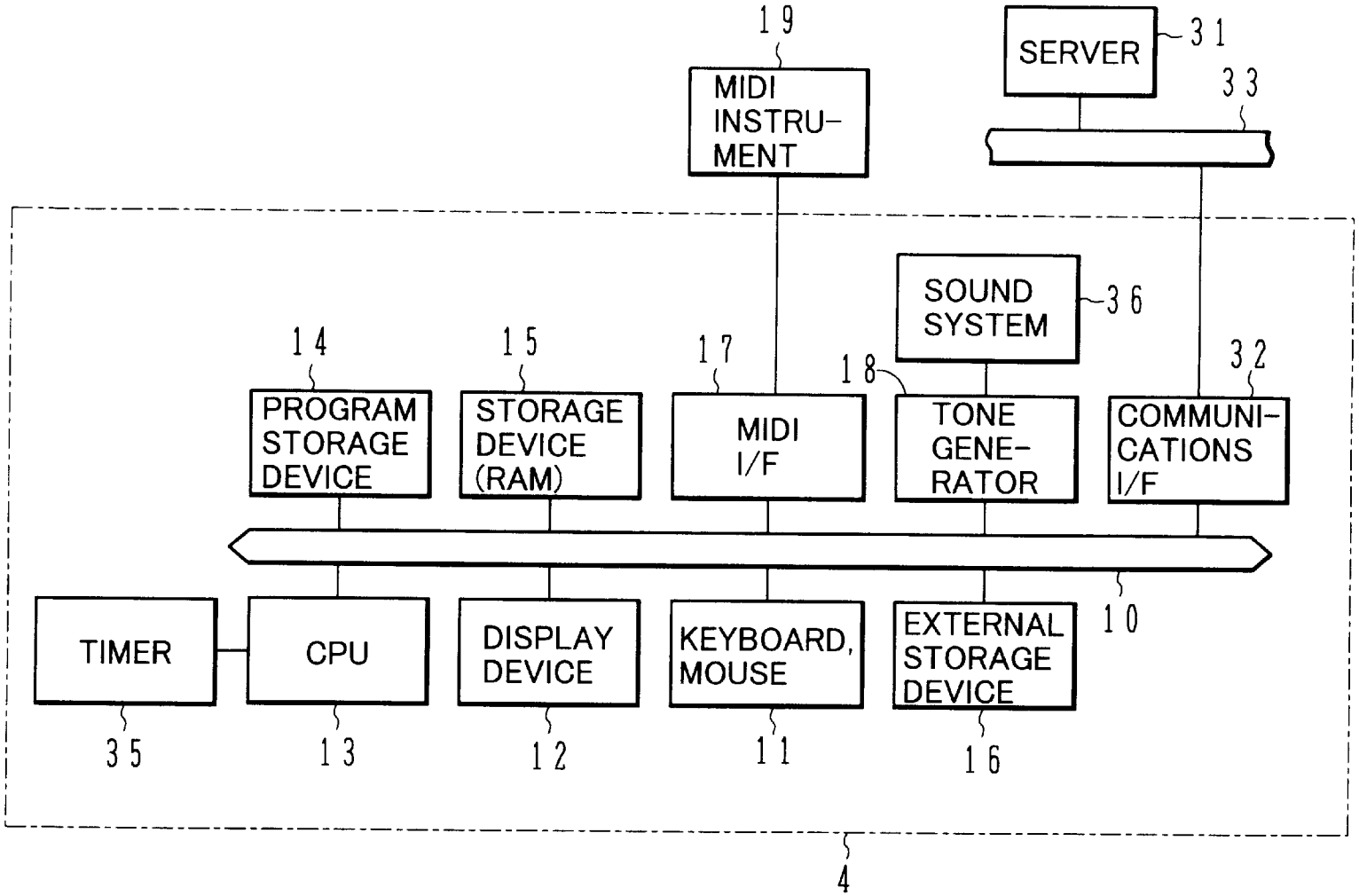
FIG. 7 is a block diagram showing the configuration of hardware of a computer.

FIG. 7 shows the hardware structure of the computer 4 realizing the MIDI keyboard function.

Connected to a bus 10 of this computer 4 are a CPU 13, a display device 12, an input device 11 such as a keyboard and a mouse, an external storage device 16, a program storage device 14, a storage device (e.g., RAM) 15, a MIDI interface (MIDI I/F) 17, a tone generator (sound source) 18, and a communications interface 32.

The input device 11 includes the keyboard 3 and mouse 5 shown in FIG. 1A. The keyboard 3 is used as the musical instrument keyboard shown in FIG. 1C if the MIDI keyboard function is enabled, and as the computer keyboard shown in FIG. 1B if the MIDI keyboard function is disabled. A user can play a musical performance and set various data by operating upon the input device.

The display device 12 corresponds to the display device 1 shown in FIG. 1A and can display the pallet, dialog, and various setting contents. It can also display the key layout shown in FIG. 4B and FIG. 5B.

The storage device 15 stores a correspondence relation between the keys shown in FIG. 1B and their functions, and the setting contents such as a transmission MIDI channel. The storage device 15 also has working areas for flags, buffers, and the like.

The program storage device 14 may be a ROM or RAM, and stores various parameters and computer programs. CPU 13 performs calculation and control operations in accordance with a program stored in the program storage device 14.

A timer 35 is connected to CPU 13 and outputs time information. In accordance with the time information supplied from the timer 35, CPU 13 performs a timer interrupt process at a predetermined time interval. The MIDI interface 17 can transfer data to and from another MIDI instrument.

When a user depressed a key of the keyboard 3, CPU 13 generates MIDI data such as a note-on event and a control change, and stores it in the storage device 15 which may store automatic performance data containing MIDI data.

CPU 13 reads the MIDI data generated by a musical performance on the keyboard 3 from the storage device 15, and supplies musical tone parameters and effects parameters to the tone generator 18. When a start of an automatic performance is instructed, CPU 13 reads the automatic performance data from the storage device 15 and supplies musical tone parameters and effects parameters to the tone generator 18.

The tone generator 18 generates musical tone signals in accordance with the supplied musical tone parameters and effects parameters, and supplies the generated musical tone signals to a sound system 36. The sound system 36 has a D/A converter and a speaker, and converts the supplied digital musical tone signals into analog musical signals to produce corresponding sounds.

The tone generator 18 may be any type such as a waveform memory type, a frequency modulation (FM) type, a physical model type, a harmonics synthesis type, a formant synthesis type, and an analog synthesizer type using a voltage-controlled oscillator (VCO), a voltage-controlled filter (VCF), and a voltage-controlled amplifier (VCA).

The tone generator 18 is not limited only to those made of dedicated hardware, but it may be constituted of a digital signal processor (DSP) and microprograms, or a CPU and software programs.

The external storage device 16 may be a hard disk drive (HDD), a floppy disk drive (FDD), a magneto-optical (MO) disk drive, a compact disk read-only (CD-ROM) drive, or the like.

The external storage device 16 may be a hard disk drive (HDD). HDD may store therein various data such as computer programs, automatic performance data, and setting data. If a necessary computer program is stored not in the program storage device 14 but in a hard disk loaded in HDD, this program is read into the program storage device (e.g., RAM). In this case, addition, version-up and the like of a computer program become easy. The external storage device 16 may be a CD-ROM drive which can read various data and computer programs stored in a CD-ROM. The read data and computer programs are stored in a hard disk loaded in HDD. Installation, version-up and the like of a computer program become easy.

The communications interface 32 is connected to a communications network 33 such as the Internet, a local area network (LAN) and a telephone line, and via the communications network 33 to a server computer 31. If computer programs and data are not stored in a hard disk loaded in HDD, these programs and data can be downloaded from the server computer 31 into the hard disk. In this case, the computer 4 as a client transmits a command for downloading a computer program or data to the server computer 31 via the communications interface 32 and communications network 33. Upon reception of this command, the server computer 31 supplies the requested control program or data to the computer 4 via the communications network 33 which computer 4 receives it via the communications interface 32 and stores it in a hard disk loaded in HDD to thereby complete the download.

This embodiment may be reduced into practice by a commercially available personal computer or the like installed with computer programs and various data realizing the functions of the embodiment. The computer programs and various data may be supplied to a user in the form of a storage medium such as a CD-ROM and a floppy disk which the personal computer can read. If the personal computer is connected to the communications network such as the Internet, a LAN and a telephone line, the control programs and various data may be supplied to the personal computer via the communications network.

Figure 8:
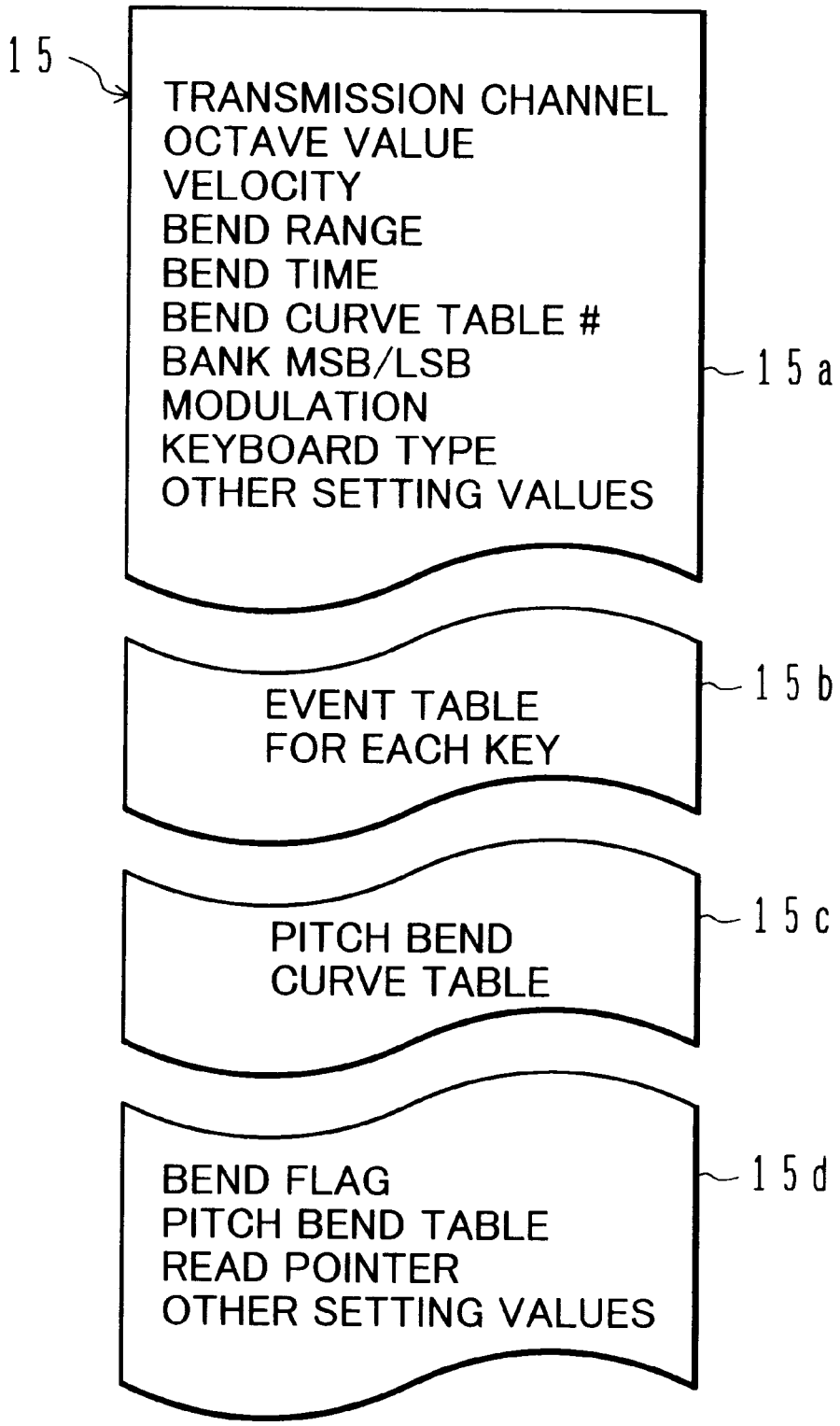
FIG. 8 shows a memory map of a storage device.

FIG. 8 is a memory map of the storage device 15 shown in FIG. 7. The storage device 15 has storage areas 15*a*, 15*b*, 15*c*, and 15*d*.

The storage area 15*a* stores a transmission MIDI channel, an octave value, a velocity value, a pitch bend range, a pitch bend time, a table number of a pitch bend curve, a setting byte for a bank number MSB or LSB), a depth of modulation, a keyboard type (one-stage keyboard or two-stage keyboard), and other setting values.

The storage area 15*b* stores a table which stores a correspondence relation between keys of the keyboard 3 and corresponding events.

The storage area 15*c* stores a table which stores a plurality type of pitch bend curves. This table stores a pitch value change with time.

The storage area 15*d* stores a bend flag indicating whether or not the [Ctrl] key 58 corresponding to the pitch bend wheel is depressed, a pointer to a read address of the pitch bend table, and other flags and registers.

Figure 9:
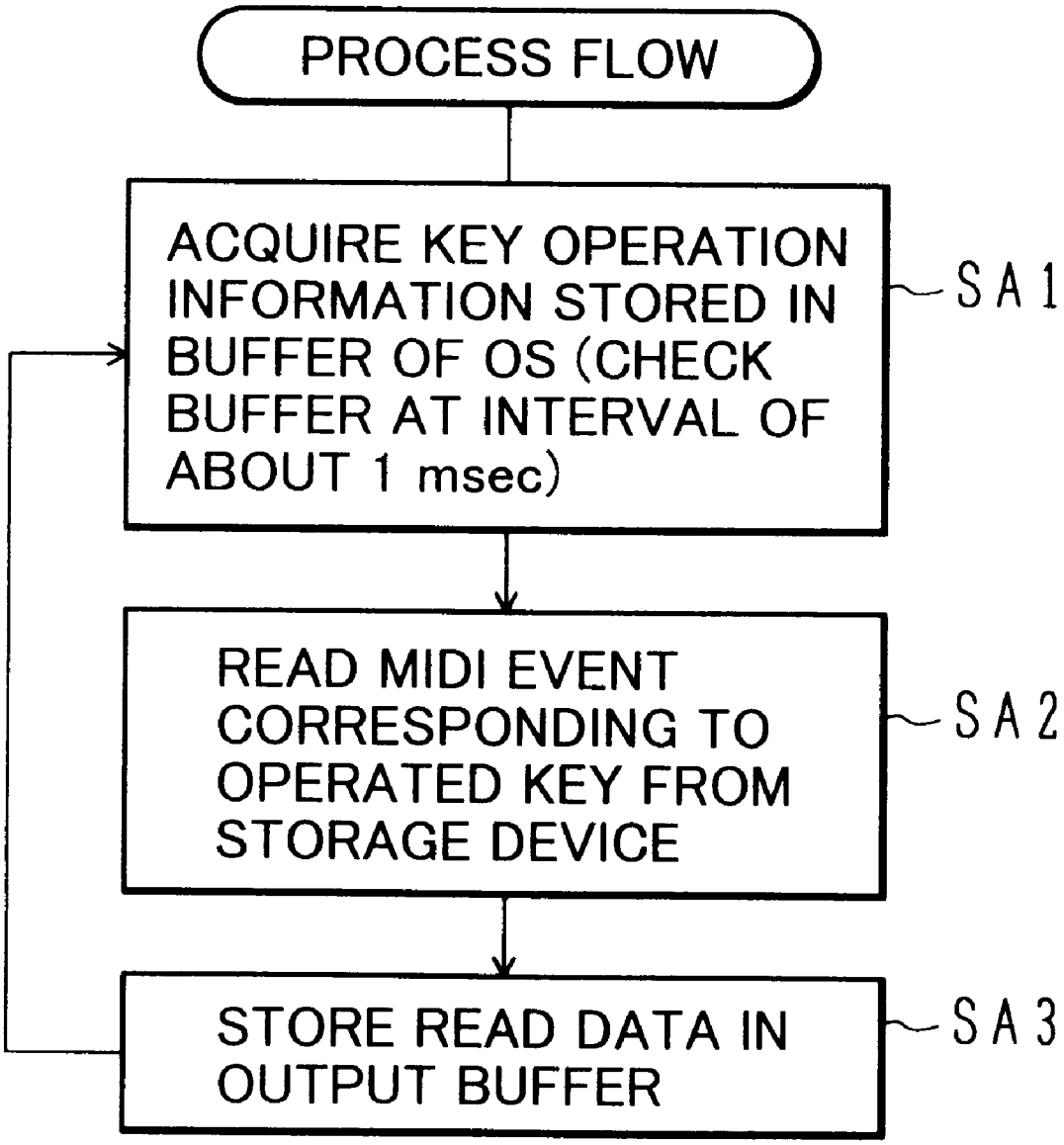
FIG. 9 is a flow chart illustrating a basic process.

FIG. 9 is a flow chart illustrating the fundamental operation.

At Step SA1, key operation information stored in a key buffer of an operating system (OS) is acquired. For example, the key buffer is searched at a relatively short interval (at a short period (at an interval of about 1 msec) capable of detecting key operation information as performance information) to acquire key operation information. OS is for example, Windows 95. The key operation information of the keyboard 3 is being stored in a predetermined buffer. In order to play a musical performance in real time, it is necessary to search the key buffer at a short interval.

Even if the MIDI keyboard function as well as other application software are operating in parallel, the key operation information in the key buffer is prevented from being acquired by the other application software, because of a relatively short period of acquiring the key operation information. If OS is Windows, it is preferable that an application of an active window detects an event (key operation information).

At Step SA2, a MIDI event corresponding to the operated key is read from the storage device 15. A relation between each key and a corresponding MIDI event is being stored in the storage area 15*b*. In accordance with this relation, the MIDI event is generated.

At Step SA3, the read MIDI event is loaded in an output buffer to thereafter return to Step SA1. Windows 95 has application software called a MIDI mapper. The MIDI mapper determines a storage address at which the MIDI event is stored, and a link between a MIDI input instrument and a MIDI output instrument. The MIDI input instrument stores an input MIDI event at the storage address. The MIDI output instrument reads the MIDI event stored at the storage address, and performs a sound reproduction process.

At Step SA3, th e MIDI event is stored at the storage address. CPU 13 searches the MIDI event periodically at a short interval, and supplies a tone parameter and the like corresponding to the MIDI event to the tone generator 18. In accordance with the tone parameter and the like, a musical tone signal is generated and the sound system produces sound in accordance with the tone signal.

The MIDI event may be output from the MIDI interface 17 to the MIDI instrument 19 to produce sound.

Figure 10:
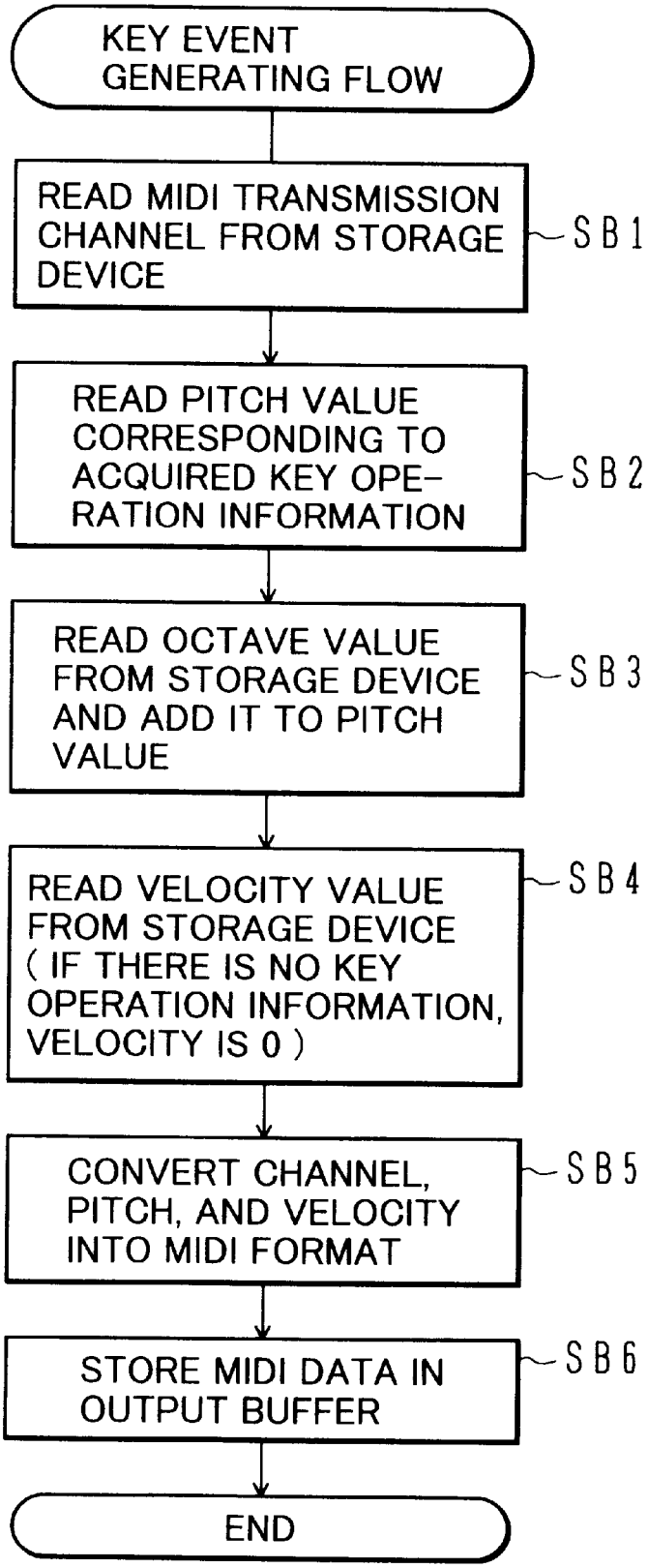
FIG. 10 is a flow chart illustrating a key event generating process.

FIG. 10 is a flow chart illustrating a key event generating process. A note key processing among the key operation information processing will be described specifically.

At Step SB1, a transmission MIDI channel is read from the storage area 15*a* (FIG. 8).

At Step SB2, a pitch value corresponding to the key operation information acquired at Step SA1 of FIG. 9 is read from the storage area 15*b* (FIG. 8). For example, as shown in FIG. 1C, the note keys 17*w* and 17*b* are assigned pitches C3 to G4.

At Step SB3, an octave value is read from the storage area 15*a* and added to the pitch value read at Step SB2.

At Step SB4, a velocity value is read from the storage area 15*a* (FIG. 8).

When the note key is depressed, a note-on event is generated, and when a note key is released after it was depressed, a note-off event is generated. Since the velocity value in the note-off event is not used ordinarily, it is always set to 0. The note-off event may not be generated, but only the note-on event may be generated.

At Step SB5, the transmission MIDI channel, pitch value, and velocity value are converted into a MIDI format to generate the note-on event or note-off event.

At Step SB6, the note-on event or note-off event is loaded in the output buffer (same as that used at Step SA3 of FIG. 9) to thereafter terminate the process. The note-on event in the output buffer is processed in the same manner described above to produce sound from the sound system 36 (FIG. 7).

Figure 11:
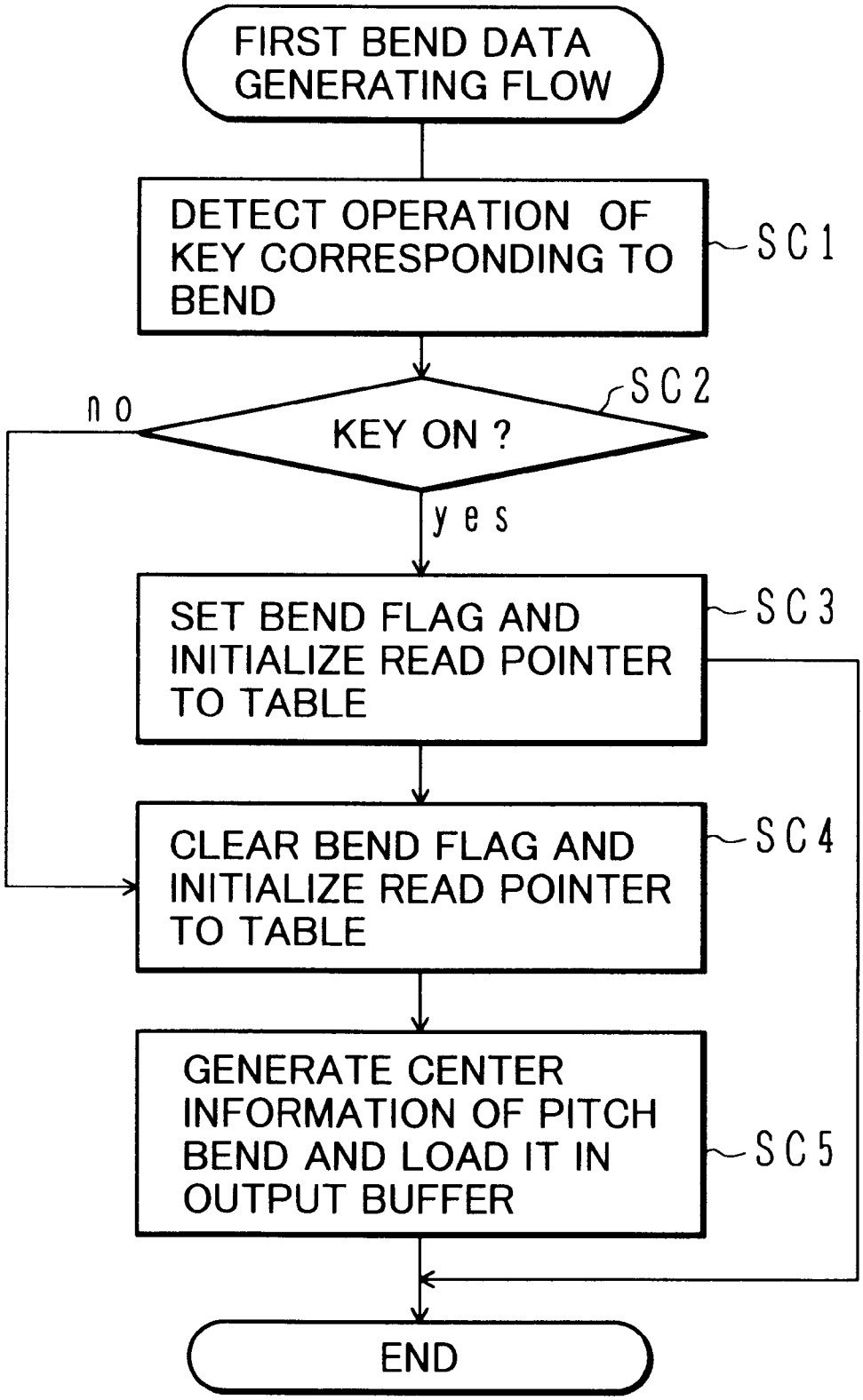
FIG. 11 is a flow chart illustrating a first bend data generating process.

FIG. 11 is a flow chart illustrating a first pitch bend data generating process. If the [Ctrl] key 58 continues to be depressed, the pitch bend makes the pitch continue to change toward a target value. When the [ctrl] key 58 is depressed, the pitch takes the original value.

When the [Ctrl] key is depressed, the pitch can be raised, and when the [Ctrl] key and [Shift] key are depressed at the same time, the pitch can be lowered. Both the operations are processed in a similar manner. Therefore, in the following, only the process to be executed when the [Ctrl] key is depressed will be described.

At Step SC1, operation information of the [Ctrl] key 58 corresponding to the pitch bend wheel is detected. Namely, a depression of the [Ctrl] key 58 is detected as a key-on event, and a release of the [Ctrl] key 58 is detected as a key-off event.

At Step SC2 it is checked whether the event is a key-on event or a key-off event. If it is the key-on event, the flow advances to Step SC3, whereas if it is the key-off event, the flow skips to Step SC4.

Step SC3 is a process to be executed when a user depresses the [Ctrl] key 58. At Step SC3, the bend flag in the storage area 18*d* shown in FIG. 8 is set to indicate that the [Ctrl] key 58 is being depressed.

Next, the read pointer (in the storage area 15*d* shown in FIG. 8) to the pitch bend table (in the storage area 15*c* shown in FIG. 8) is initialized. Thereafter, pitch bend data is generated by the process shown in the flow chart of FIG. 12 to be described later.

Step SC4 is a process to be executed when the user releases the [Ctrl] key 58. At Step SC4, the bend flag in the storage area 18*d* is cleared to indicate that the [Ctrl] key 58 was released.

Next, the read pointer to the pitch bend table is initialized to prepare for the next pitch bend process.

At Step SC5, the center information of the pitch bend is generated and loaded in the output buffer. The pitch bend wheel is positioned at the center when it is not operated upon. Therefore, after the user releases the [Ctrl] key 58, a musical tone having a pitch corresponding to the center information is produced. Thereafter, the process is terminated.

Figure 12:
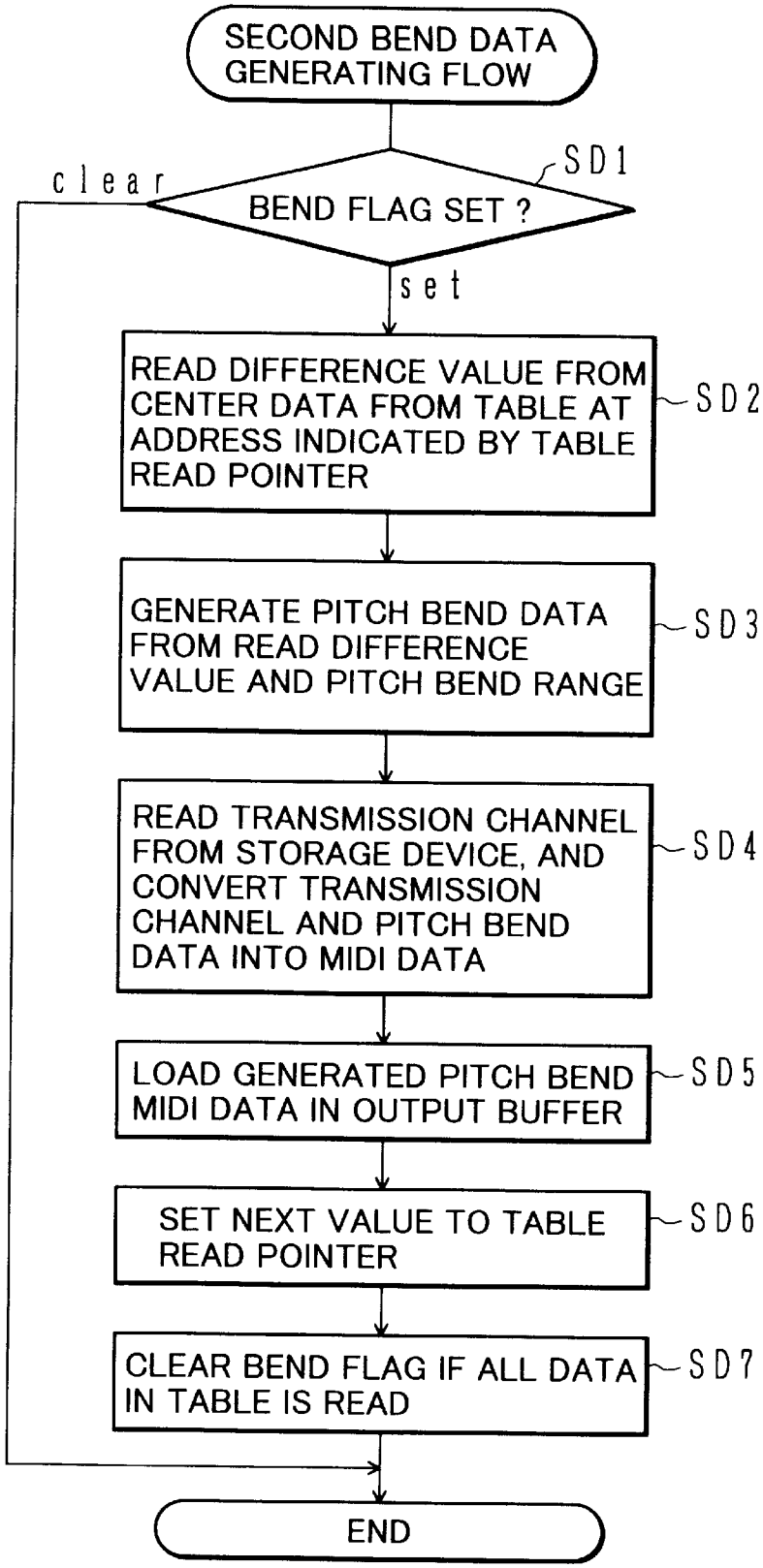
FIG. 12 is a flow chart illustrating a second bend data generating process.

FIG. 12 is a flow chart illustrating a second pitch bend data generating process. This process is executed upon reception of a timer interrupt. The period of a timer interrupt is determined from the following equation in accordance with the pitch bend time and the number of points in the pitch bend table. The pitch bend time is a time required to reach the target pitch value.

Period=Pitch bend time/table point number

First, at Step SD1 it is checked whether the bend flat is being set or cleared. If cleared, the process is terminated without executing any operation, whereas if set, the flow advances to Step SD2.

At Step SD2, data indicated by the read pointer to the pitch bend table is acquired from the pitch bend table. A difference between the center data and the acquired data is calculated.

At Step SD3, in accordance with the difference and the pitch bend range, the pitch bend data is generated. The pitch bend range is a range of a pitch to be changed by the pitch bend. The pitch bend is obtained by multiplying the pitch bend range value by a coefficient corresponding to the difference.

At Step SD4 the transmission MIDI channel is read from the storage area 15*a* (FIG. 8). The transmission MIDI channel and pitch bend data are converted into the MIDI format to generate the MIDI data.

At Step SD5 the generated MIDI data of the pitch bend is loaded in the output buffer. The MIDI data in the output buffer is processed in a similar manner described earlier to change the pitch of a note under reproduction.

At Step SD6 the read pointer to the pitch bend table is set with the next value to prepare for reading the next pitch bend data. If the [Ctrl] key 58 continues to be depressed, the above process is repeated at a predetermined interval so that the pitch bend data in the pitch bend table is sequentially read and the MIDI data of the pitch bend is generated.

At Step SD7 it is checked whether all the values in the pitch bend table are read. If read, it means that the pitch reached the target pitch value. Therefore, the bend flag is cleared and the pitch is maintained unchanged at the next timer interrupt without reading the pitch bend table.

As the [Ctrl] key 58 continues to be depressed, the pitch continues to change toward the target pitch value. When the [Ctrl] key 58 is released, the pitch takes a value corresponding to the center value of the pitch bend wheel.

As described above, when the MIDI keyboard function is enabled, the computer keyboard can be used as a musical instrument keyboard, and when the MIDI keyboard function is disabled, it can be used as the computer keyboard itself. The performance operators such as musical instrument keyboard white and black keys, pitch bend, and modulation wheel can be assigned to a computer keyboard.

Musical performance similar to an electronic musical instrument with a keyboard can be made and MIDI data can be generated by using a computer without using an electronic musical instrument with a keyboard.

Since the MIDI keyboard function can be enabled or disabled with a simple operation, it is easy to switch between a computer keyboard and a musical instrument keyboard.

It is preferable to instruct to extinguish all sounds under reproduction (all notes off) and initialize various settings of the tone generator (reset all controllers, GMon, XGon, and the like), before the MIDI keyboard function is disabled or the computer keyboard function is enabled.

The present invention has been described in connection with the preferred embodiments. The invention is not limited only to the above embodiments. It is apparent that various modifications, improvements, combinations, and the like can be made by those skilled in the art.

What is claimed is:

1. An apparatus for using a computer keyboard as a musical instrument keyboard, the apparatus comprising:

a computer keyboard having a plurality of keys for generating key information upon operation of each key;

switching device which switches between an enable state and a disabled state of a musical instrument keyboard function; and MIDI data generator which generates MIDI data corresponding to the key information upon operation of each key of said computer keyboard if the musical instrument keyboard function is in the enabled state.

2. An apparatus for using a computer keyboard as a musical instrument keyboard according to claim 1, wherein said switching device enables or disables the musical instrument keyboard function by operating a particular key of said computer keyboard.

3. An apparatus for using a computer keyboard as a musical instrument keyboard according to claim 1, wherein said computer keyboard has a layout of keys according to standards institute.

4. An apparatus for using a computer keyboard as a musical instrument keyboard according to claim 1, further comprising a display which displays an indication that the musical instrument keyboard function is being enabled.

5. An apparatus for using a computer keyboard as a musical instrument keyboard according to claim 1, further comprising keyboard assigning device which assigns at least a one-stage keyboard or a two-stage keyboard to said computer keyboard, wherein said MIDI data generator generates a note-on event in a first compass when a key in a first area of said computer keyboard is operated, and generates a note-on event in a second compass when a key in a second area of said computer keyboard is operated, respectively when the two-stage keyboard is assigned.

6. An apparatus for using a computer keyboard as a musical instrument keyboard according to claim 1, wherein said MIDI data generator generates a note-on event in a certain compass, and the apparatus further comprises compass shifting device which shifts a compass of an note-on event generated by said MIDI data generator.

7. An apparatus for using a computer keyboard as a musical instrument keyboard according to claim 1, further comprising velocity changing device which changes a velocity value, wherein said MIDI data generator generates a note-on event containing an initial velocity value or a changed velocity value.

8. An apparatus for using a computer keyboard as a musical instrument keyboard according to claim 1, further comprising musical tone characteristic designating device which designates musical characteristics including a change of a parameter with time, a target parameter value, and a time taken to reach the target parameter value, wherein said MIDI data generator generates the MIDI data in accordance with the change of a parameter with time, the target parameter value, and the time taken to reach the target parameter value, respectively designated by said musical tone characteristic designating device.

9. An apparatus for using a computer keyboard as a musical instrument keyboard according to claim 1, wherein said computer keyboard includes ten-keys, the apparatus further comprises numerical number designating device which designates a numerical number entered by a key of the ten-keys as a parameter of the MIDI data, and said MIDI data generator generates the MIDI data including the designated parameter.

10. An apparatus for using a computer keyboard as a musical instrument keyboard according to claim 1, further comprising function assigning device which assigns a predetermined function to each of said computer keyboard, wherein said MIDI data generator generates the MIDI data having a function entered by a key and assigned by said function assigning device to the key.

11. An apparatus for using a computer keyboard as a musical instrument keyboard according to claim 1, further comprising a MIDI interface capable of transmitting the MIDI data to an external apparatus and transmission instruction device which instructs to transmit the MIDI data generated by said MIDI data generator to the external apparatus via said MIDI interface.

12. An apparatus for using a computer keyboard as a musical instrument keyboard according to claim 1, further comprising sound generating device which generates sound in accordance with the MIDI data generated by said MIDI data generator.

13. An apparatus for using a computer keyboard as a musical instrument keyboard according to claim 1, further comprising storage device having a MIDI data storage area designated as an area for storing the MIDI data, wherein said storage device stores the MIDI data generated by said MIDI data generator in the MIDI data storage area.

14. An apparatus capable of using a computer keyboard as a musical instrument keyboard according to claim 6, wherein said compass shifting device shifts the compass by operating a key of said computer keyboard.

15. An apparatus for using a computer keyboard as a musical instrument keyboard, according to claim 2, wherein said switching device switches between the enabled state and the disabled state of the musical instrument keyboard function by operating two or more keys of said computer keyboard at the same time.

16. A method of using a computer keyboard as a musical instrument key board, comprising the steps of:

(a) switching between an enable state and a disabled state of a musical instrument keyboard function;

(b) generating key information upon operation of each key of a plurality of keys of a computer keyboard; and (c) generating MIDI data corresponding to the key information upon operation of each key of the computer keyboard if the musical instrument keyboard function is in the enabled state.

17. A method of using a computer keyboard as a musical instrument keyboard according to claim 16, wherein said step (a) enables or disables the musical instrument keyboard function by operating a particular key of the computer keyboard.

18. A method of using a computer keyboard as a musical instrument keyboard according to claim 16, wherein the computer keyboard has a layout of keys according to standards institute.

19. A method of using a computer keyboard as a musical instrument keyboard according to claim 16, further comprising a step of:

(d) displaying an indication that the musical instrument keyboard function is being enabled.

20. A method of using a computer keyboard as a musical instrument keyboard according to claim 16, further comprising a step of:

(e) assigning at least a one-stage keyboard or a two-stage keyboard to the computer keyboard, wherein said step (c) generates a note-on event in a first compass when a key in a first area of the computer keyboard is operated, and generates a note-on event in a second compass when a key in a second area of the computer keyboard is operated, respectively when the two-stage keyboard is assigned.

21. A method of using a computer keyboard as a musical instrument keyboard according to claim 16, wherein said step (c) generates a note-on event in a certain compass, and the method further comprises a step of:

(f) shifting a compass of an note-on event generated by said step (c).

22. A method of using a computer keyboard as a musical instrument keyboard according to claim 16, further comprising a step of:

(g) changing a velocity value, wherein said step (c) generates a note-on event containing an initial velocity value or a changed velocity value.

23. A method of using a computer keyboard as a musical instrument keyboard according to claim 16, further comprising a step of:

(h) designating musical characteristics including a change of a parameter with time, a target parameter value, and a time taken to reach the target parameter value, wherein said step (c) generates the MIDI data in accordance with the change of a parameter with time, the target parameter value, and the time taken to reach the target parameter value, respectively designated at said step (h).

24. A method of using a computer keyboard as a musical instrument keyboard according to claim 16, wherein the computer keyboard includes ten-keys, and the method further comprises a step of:

(i) designating a numerical number entered by a key of the ten-keys as a parameter of the MIDI data, wherein said step (c) generates the MIDI data including the designated parameter.

25. A method of using a computer keyboard as a musical instrument keyboard according to claim 16, further comprising a step of:

(j) assigning a predetermined function to each of the computer keyboard, wherein said step (c) generates the MIDI data having a function entered by a key and assigned at said step (j) to the key.

26. A method of using a computer keyboard as a musical instrument keyboard according to claim 16, further comprising a step of:

(k) transmitting the MIDI generated at said step (c) to an external apparatus via a MIDI interface.

27. A method of using a computer keyboard as a musical instrument keyboard according to claim 16, further comprising a step of:

(l) generating sound in accordance with the MIDI data generated at said step (c).

28. A method of using a computer keyboard as a musical instrument keyboard according to claim 16, further comprising a step of (m) storing the MIDI data generated at said step (c) in a MIDI data storage area designated as an area for storing the MIDI data.

29. A storage medium storing a program to be executed by a computer, the program comprising the steps of:

(a) switching between an enable state and a disabled state of a musical instrument keyboard function;

(b) generating key information upon operation of each key of a plurality of keys of a computer keyboard; and (c) generating MIDI data corresponding to the key information upon operation of each key of the computer keyboard if the musical instrument keyboard function is in the enabled state.

30. A storage medium storing a program to be executed by a computer, according to claim 29, wherein said step (a) enables or disables the musical instrument keyboard function by operating a particular key of the computer keyboard.

31. A storage medium storing a program to be executed by a computer, according to claim 29, wherein the computer keyboard has a layout of keys according to standards institute.

32. A storage medium storing a program to be executed by a computer, according to claim 29, wherein the program further comprises a step of:

(d) displaying an indication that the musical instrument keyboard function is being enabled.

33. A storage medium storing a program to be executed by a computer, according to claim 29, wherein the program further comprises a step of:

(e) assigning at least a one-stage keyboard or a two-stage keyboard to the computer keyboard, wherein said step (c) generates a note-on event in a first compass when a key in a first area of the computer keyboard is operated, and generates a note-on event in a second compass when a key in a second area of the computer keyboard is operated, respectively when the two-stage keyboard is assigned.

34. A storage medium storing a program to be executed by a computer, according to claim 29, wherein said step (c) generates a note-on event in a certain compass, and the program further comprises a step of:

(f) shifting a compass of an note-on event generated by said step (c).

35. A storage medium storing a program to be executed by a computer, according to claim 29, wherein the program further comprises a step of:

(g) changing a velocity value, wherein said step (c) generates a note-on event containing an initial velocity value or a changed velocity value.

36. A storage medium storing a program to be executed by a computer, according to claim 29, wherein the program further comprises a step of:

(h) designating musical characteristics including a change of a parameter with time, a target parameter value, and a time taken to reach the target parameter value, wherein said step (c) generates the MIDI data in accordance with the change of a parameter with time, the target parameter value, and the time taken to reach the target parameter value, respectively designated at said step (h).

37. A storage medium storing a program to be executed by a computer, according to claim 29, wherein the program further comprises a step of:

(i) designating a numerical number entered by a key of the ten-keys as a parameter of the MIDI data, wherein said step (c) generates the MIDI data including the designated parameter.

38. A storage medium storing a program to be executed by a computer, according to claim 29, wherein the program further comprises a step of:

(j) assigning a predetermined function to each of the computer keyboard, wherein said step (c) generates the MIDI data having a function entered by a key and assigned at said step (j) to the key.

39. A storage medium storing a program to be executed by a computer, according to claim 29, wherein the program further comprises a step of:

(k) transmitting the MIDI generated at said step (c) to an external apparatus via a MIDI interface.

40. A storage medium storing a program to be executed by a computer, according to claim 29, wherein the program further comprises a step of:

(l) generating sound in accordance with the MIDI data generated at said step (c).

41. A storage medium storing a program to be executed by a computer, according to claim 29, wherein the program further comprises a step of:

(m) storing the MIDI data generated at said step (c) in a MIDI data storage area designated as an area for storing the MIDI data.

42. An apparatus for using a computer keyboard as a musical instrument keyboard, the apparatus comprising:

a computer keyboard having a plurality of keys for generating key information upon operation of each key;

means for switching between an enable state and a disabled state of a musical instrument keyboard function; and MIDI data generating means for generating MIDI data corresponding to the key information upon operation of each key of said computer keyboard if the musical instrument keyboard function is in the enabled state.

* * * * *